US005499856A

United States Patent [19]

Sorrell et al.

[11] Patent Number: 5,499,856

[45] Date of Patent: Mar. 19, 1996

[54] FOLDABLE FRONT-ENTRY WALKER HAVING RESISTANCE TO BACKWARD MOTION

[75] Inventors: Michael R. Sorrell, Longmeadow, Mass.; Lawrence W. Engdahl, Guilford, Conn.; Simon Slootsky, Newton, Mass.

[73] Assignee: Sorrell Medical, Incorporated, Longmeadow, Mass.

[21] Appl. No.: 258,703

[22] Filed: Jun. 13, 1994

[51] Int. Cl.[6] ..... A61H 3/04

[52] U.S. Cl. ..... 297/5; 297/35; 297/16.1; 297/344.18; 135/66; 135/67

[58] Field of Search ..... 297/5, 6, 35, 38, 297/16.1, 50, 344.18, 219.1, 45; 135/65, 66, 67, 74

[56] References Cited

U.S. PATENT DOCUMENTS

| | | | |
|---|---|---|---|
| 2,129,260 | 9/1938 | Bowser | 297/5 |
| 2,362,466 | 11/1944 | Carter | 297/5 |
| 2,592,879 | 4/1952 | Eyerly . | |
| 3,354,893 | 11/1967 | Schmerl . | |
| 3,516,425 | 6/1970 | Rigal . | |
| 4,298,016 | 11/1981 | Garelick . | |
| 4,452,484 | 6/1984 | Pastor | 297/5 |
| 4,481,965 | 11/1984 | Watkins . | |
| 4,532,948 | 8/1985 | Burrows . | |
| 4,579,390 | 4/1986 | Guille | 297/45 |
| 4,621,804 | 11/1986 | Mueller . | |
| 4,700,730 | 10/1987 | Samuelson et al. . | |
| 4,800,910 | 1/1989 | Gamm . | |
| 4,801,176 | 1/1989 | Wolberg . | |
| 4,826,241 | 5/1989 | Barras . | |
| 5,058,912 | 10/1991 | Harroun . | |
| 5,271,422 | 12/1993 | Sorrell et al. . | |
| 5,320,122 | 6/1994 | Jacobsen et al. | 135/67 |
| 5,346,278 | 9/1994 | Dehondt | 297/219.1 |

FOREIGN PATENT DOCUMENTS

| | | |
|---|---|---|
| 1093949 | 1/1981 | Canada . |
| 0229445 | 7/1987 | European Pat. Off. . |
| 2154149 | 9/1985 | United Kingdom . |

*Primary Examiner*—Peter M. Cuomo
*Assistant Examiner*—Anthony D. Barfield
*Attorney, Agent, or Firm*—Richard H. Kosakowski; Holland & Bonzagni

[57] ABSTRACT

A foldable front-entry safety walker is disclosed having a resistance to backward motion of the walker. Various embodiments of the walker are disclosed. The walker includes a pair of side frames, along with a corresponding pair of front legs and a pair of rear legs. A foldable seat is disposed at the rear portion of the walker. The walker is relatively lightweight allowing a person with limited walking ability to easily advance the walker forward. The rear legs may have spring-loaded brakes that are functional to prevent backward motion of the walker under certain conditions. If the user falls backward for whatever reason, the user will strike either the seat back or the seat cushion and the force of the falling body will activate a spring-loaded rear legs to prevent backward motion of the walker.

19 Claims, 6 Drawing Sheets

FOLDABLE FRONT-ENTRY WALKER HAVING RESISTANCE TO BACKWARD MOTION

BACKGROUND OF THE INVENTION

This invention relates to safety walkers, and more particularly, to a foldable front-entry walker that resists movement of the walker during a backward fall by the user.

Ambulation devices, such as walkers, have long been known in the prior art. In its most basic form, such a walker comprises a frame made up of a plurality of tubular members that a person enters from the rear and stands behind. The entire structure is in front of the person. The walker often has rubber feet that contact the floor. In order to move the walker in any direction, usually forward, the person typically must pick up the walker and simultaneously move it and himself/herself as well. Sometimes wheels are provided for some or all of the legs. The wheels obviate the need to pick up the walker in order to move it. In any event, this type of walker is feasible only for people with relatively minor disabilities where there is little or no chance that the user will lose his/her balance and fall. Such a walker would not prevent the falling person to strike the ground and possibly injure himself/herself.

Other walkers are known that are built to "surround" the person in a frame, and usually include a seat. See, for example, U.S. Pat. No. 5,058,912 to Harroun. In this walker, the seat functions merely as a resting device. There is little the walker could do to prevent a person falling backward from injury. This is because the walker will move when the falling person contacts any part of the walker. Other walkers, such as those described in U.S. Pat. No. 4,532,948, have a seat that provides a portable resting place for the user. To use the seat however, the patient must turn around or bring the walker behind him/her.

Persons with Parkinson's Disease, multiple cerebral infarcts, orthopedic and arthritic afflictions of the legs and feet, and other similar conditions frequently tilt, shuffle, stumble and fall as a result of diseases of the bone, joint and nervous systems. Also, persons with Parkinson's Disease, hydrocephalus, multiple small strokes, and other neurologic conditions affecting the basal ganglia, ventricular system, and the long motor tracts bordering the ventricles of the brain have a defect of the righting reflex. Those afflicted often stumble backwards, retropulse, either spontaneously or in response to a minor stimulus. They also stumble when turning. Persons with bony deformities of the legs and feet can also fall backwards uncontrollably from mechanical disadvantage.

Backward falls are the most dangerous events when persons use a walker. When a person falls or steps backwards, he/she must be stopped by an object which will not flip over once it has met the force of the falling body. Any structure may tip over if enough torque causes the object to rotate on the fulcrum of a fixed point. Although most modern walkers have height adjustable legs, are lightweight and of stable construction, they can not adequately stop a person who falls backwards.

However, the foldable safety walker described and claimed in U.S. Pat. No. 5,271,422 to Sorrell et al. is an exception in that it provides resistance to backward falls. A key feature of that patent is that the rear legs are bent backwards at an angle which resists the force of the falling body. Further, the walker has a seat at the rear of the walker. Therefore, the user can sit down in a natural, safe movement, avoiding further risk of falling. The walker is foldable into a compact unit. A number of foldable joints are provided to facilitate the folding (see FIGS. 5A, 5B, 6–8). However, the seat is made from a flexible material; thus the seat, not being rigid, is not foldable in a manner much like that of a chair with a rigid seat back and seat cushion.

Accordingly, it is a primary object of the present invention to provide a foldable safety walker with a foldable seat disposed at the rear of the walker, the walker having a predetermined resistance to backward rolling motion of the walker.

It is a general object of the present invention to provide a foldable safety walker that prevents the user from falling to the floor when the user falls backward toward the seat of the walker.

It is a further object of the present invention to provide a foldable safety walker that prevents serious injury to a user when that person falls backward.

It is yet another object of the present invention to provide a foldable safety walker that has little or no backward motion when the force of a backward-falling person contacts the seat of the walker.

It is still another object of the present invention to provide a foldable safety walker that is of the front-entry type in that a user walks within the frame of the walker and forward of the seat.

It is another object of the present invention to provide a foldable safety walker that is lightweight (approximately 12 pounds or less), and that is quickly and easily foldable for ease of storage and transportability.

It is still another object of the present invention to provide a foldable safety walker that allows the user freedom of movement while, at the same time, providing a sense of safety to the user.

It is yet another object of the present invention to provide a foldable safety walker that does not flip over once the rigid seat cushion or rigid seat back has met the force of the falling body.

It is another object of the present invention to provide a foldable safety walker that has a seat and a frame such that it provides both a space and a support for walking forward of the seat, such that a person with limited walking ability may stand erect and walk forward by stepping or shuffling his/her feet.

The above and other objects and advantages of this invention will become more readily apparent when the following description is read in conjunction with the accompanying drawings.

SUMMARY OF THE INVENTION

To overcome the deficiencies of the prior art and to achieve the objects listed above, the Applicants have invented a foldable front-entry walker having a resistance to backward motion of the walker. Several embodiments of the walker are disclosed. Common to all of the embodiments is that the walker comprises a pair of parallel side frames comprising arms and lower tension braces. A pair of vertical front legs are provided. The legs are height-adjustable. In one instance the legs include extensions that are integral hand-gripable canes. In the alternative, the tension braces include the integral hand-gripable cane extensions. A pair of height-adjustable rear legs are also provided. The legs have spring-loaded wheels attached at the bottom portions thereof. A foldable seat is located at the rear of the walker.

The seat defines a place for the user to sit and includes a seat back and seat cushion.

In operation, the user enters the walker from the front and grabs the canes. The lightweight walker is easily advanced forward by a light pulling force. This allows someone with limited walking ability to walk forward by stepping or shuffling his/her feet. If the user wishes to stop and rest, it is a simple matter for the user to sit on the seat cushion. However, a major utility of the walker of the present invention occurs when the user, for whatever reason, falls backward. Upon falling, if the person initially contacts the front edge of the seat cushion, the person applies a downward and backward force on the edge of the seat cushion. The downward component of this force activates the spring-loaded wheels, which act as brakes that prevent any rearward motion of the walker under certain conditions. On the other hand, if the person is at a forward point at the time of a rigid backward fall, such that he/she initially contacts the seat back, then the wheel brakes are immediately activated. The walker may rotate upwards slightly until the front of the seat cushion engages the user's legs or backside, thereby arresting the fall of the user. The person would then fall into a seated position.

DETAILED DESCRIPTION OF THE PREFERRED EMBODIMENTS

Figure 1:
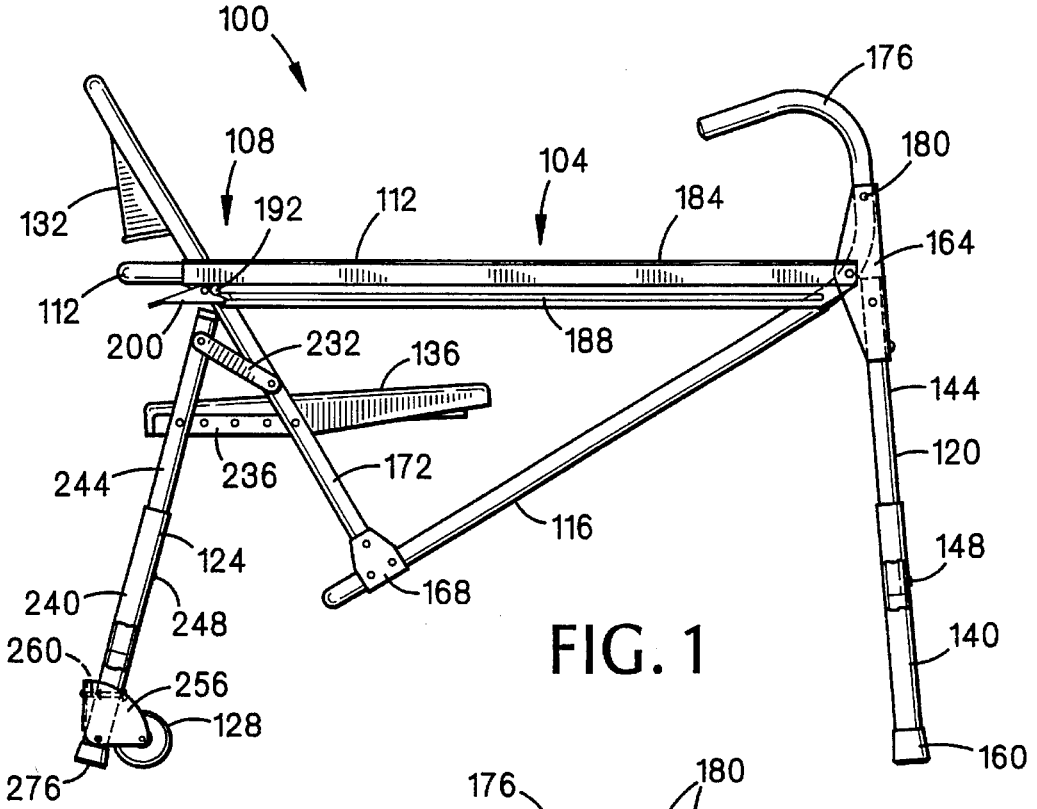
FIG. 1 is a side view of one embodiment of a foldable safety walker of the present invention illustrated in a unfolded, in-use position.

Referring to the drawings in detail, several exemplary embodiments of a foldable safety walker having resistance to backward motion are generally illustrated and the walker in all embodiments is designated by the reference numeral 100. Identical reference numerals are used to identify identical elements in all of the various embodiments. The walker 100 generally comprises a frame section 104 and a seat section 108. The frame 104 includes a pair of parallel-oriented side portions, each side portion having an arm 112 and a lower tension brace 116. The frame 104 also includes a pair of front legs 120 and a pair of rear legs 124. The rear legs 124 have spring-loaded wheels 128 that act as brakes to prevent rearward motion of the walker 100. The seat section 108 includes a seat back 132 and a seat cushion 136 connectable with the frame 104.

Figure 2:
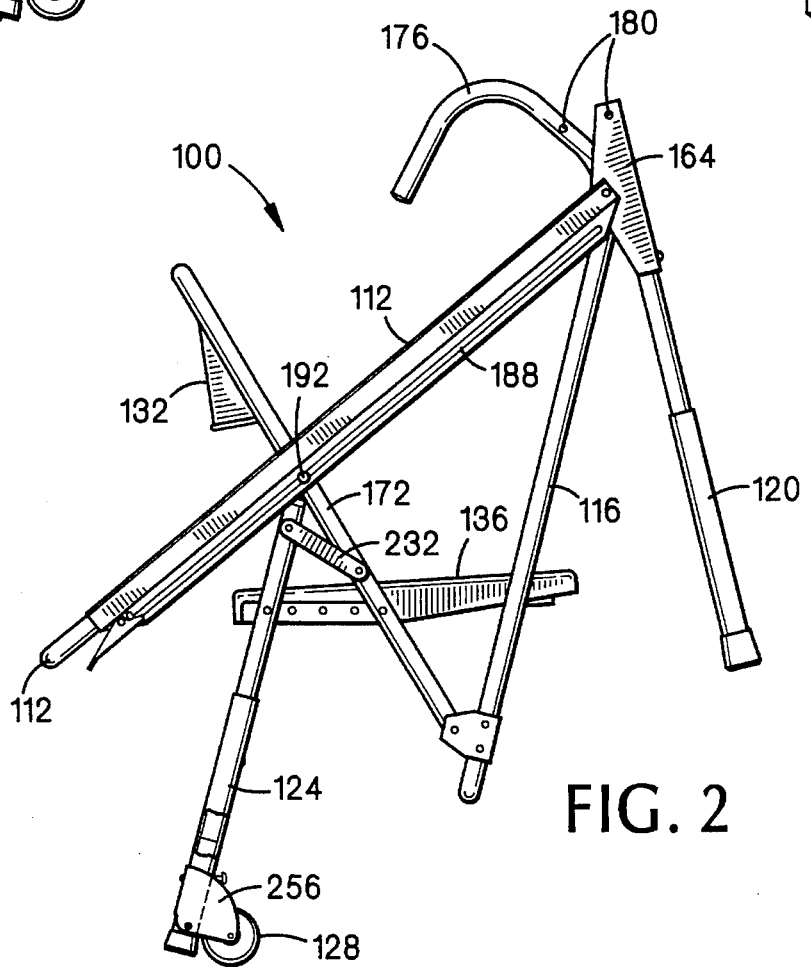
FIG. 2 is a side view of the walker of FIG. 1 illustrated in a partially folded position.
Figure 3:
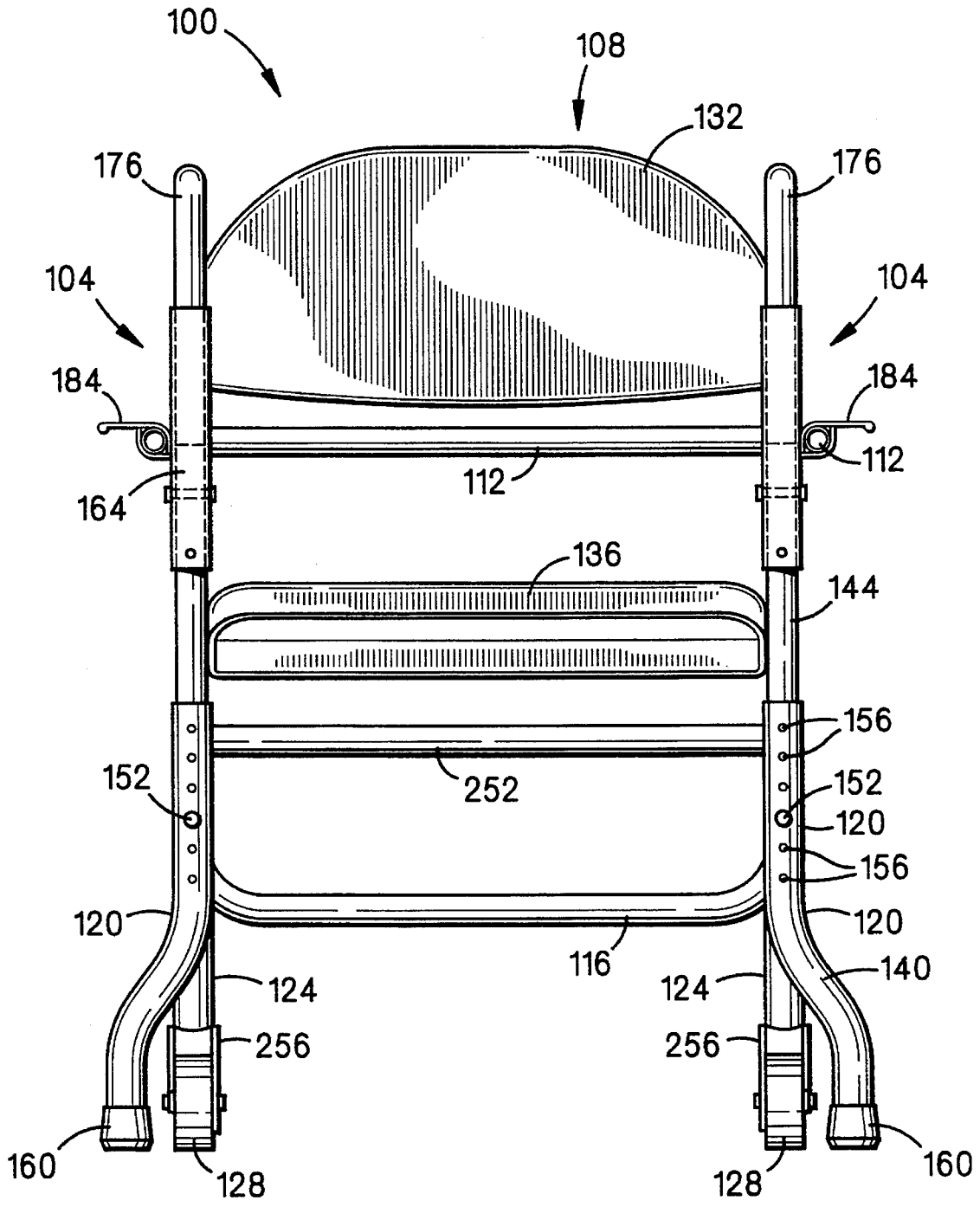
FIG. 3 is a front view of the walker of FIG. 1 illustrated in an unfolded position.
Figure 8:
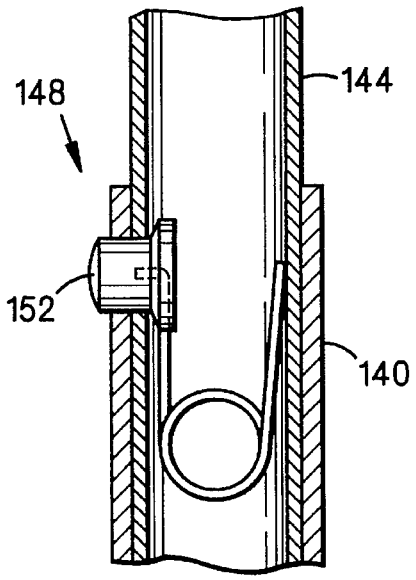
FIG. 8 illustrates a detailed perspective view, in partial cross-section, illustrating a push button latch that forms a portion of the walker of FIG. 1.

Referring now to FIGS. 1 and 2, there illustrated are side views of a first exemplary embodiment of the foldable safety walker 100 of the present invention. FIG. 3 illustrates a front view of the walker 100 of FIGS. 1 and 2. FIG. 1 illustrates the walker 100 in an unfolded position, while FIG. 2 illustrates the walker 100 in a partially folded position. The walker 100 includes a pair of vertically upstanding front legs 120. Each leg comprises a lower tube 140 and an upper tube 144 of a smaller diameter than the lower tube 140. The upper tube 144 fits within a portion of the lower tube 140. Height-adjustable means 148 are provided for each leg 120 to adjust the vertical height of the front of the walker. In an exemplary embodiment, the height-adjustable means 148 comprises a spring-loaded push button 152 disposed within the upper tube 144 and having the button protrude through the selected one of a plurality of holes 156 aligned vertically and formed in the lower tube 140. Such a push button arrangement is shown in detail in FIG. 8. However, a pin placed through the hole in the outer tube 140 and one of the holes 156 in the inner tube 144 may be used instead.

Each leg 120 may comprise aluminum, steel or a rigid plastic or other suitable material. At the bottom floor contacting portion of each lower tube 140 is disposed a plastic or rubber cap 160 to provide both a better friction grip of the tube 140 with a floor surface, and to prevent the tube material from marring the surface of the floor.

As shown in FIG. 3, a bottom portion of each lower tube 140 may be curved in an "S"-shaped configuration or offset. This provides additional lateral stability to the walker 100 and lessens the chance that the user will bump his/her feet on the legs 120. The top of each leg 120 is secured within a triangular-shaped collar 164 made of, e.g., plastic or other suitable rigid material. The upper tube 144 of each leg 120 may be secured to the collar 164 by means of, e.g., a screw or a pin.

The frame portion 104 of the walker 100 also includes a pair of lower tension braces 116 that may also comprise, e.g., an aluminum tube. As each lower tension brace 116 approaches the rear of the walker 100 under the seat cushion 136, the tubing comprising each brace 116 is bent inward and toward each other where they eventually meet and are connected together. In a preferred embodiment, the braces 116, including both the sides and the rear portions comprise a single piece of tubing bent accordingly as illustrated. Referring to FIG. 1, each lower tension brace 116 is fixedly attached to a T-shaped collar 168 by way of, e.g., screws or pins. The collar 168 may comprise a plastic or other suitable rigid material. The collar 168 connects also to a portion of the seat frame 172, as described in detail hereinafter. The lower tension brace 116 is "U"-shaped and is a straight piece of tubing for most of its length until the tubing approaches the triangular-shaped collar 164. There, the lower tension brace 116 is curved in a "C"-shaped section that extends above the top of the triangular-shaped collar 164 to form a hand-gripable cane 176. The lower tension brace 116 is attached to the triangular-shaped collar 164 at two points. At a first point, the lower tension brace 116 is fixedly and pivotally attached by a screw or a pin to both the collar 164 and an end of an arm 112 portion of the frame 104. At a second, vertically-higher point near the top of the triangular-shaped collar 164, the lower tension brace 116 removably attaches to the collar 164 by means of a push button latch 180, similar to that illustrated in FIG. 8. FIG. 1 illustrates the cane portion 176 of the lower tension brace 116 attached to the collar 164, while FIG. 2 illustrates the cane portion 176 of the lower tension brace 116 disconnected from the collar 164.

The frame 104 of the walker 100 of FIGS. 1–3 also includes a pair of arms 112, arranged in parallel on each side of the walker 100. The arms 112 comprise, in the exemplary embodiment of FIGS. 1–3, an extruded piece of e.g., aluminum. A piece of cylindrical tubing is connected to the rear-most portion of each extrusion by e.g., screws. The arm tubing extension 112 extends around the back of the seat back 132. The front-most portion of each arm extrusion 112 is pivotally connected to both the corresponding lower tension brace 116, and the corresponding triangular-shaped collar 164. In an exemplary embodiment of FIG. 1–3, each arm 112 comprises a planar piece of aluminum that is bent in the middle at a right angle. This forms a top horizontal planar surface 184 upon which a user can rest his/her arms. It also forms a vertically-oriented side surface. This side surface pivotally connects to the lower tension brace 116 and the triangular-shaped collar 164. The side surface also has a milled or lanced guide slot 188 formed therein in an exemplary embodiment. The guide slot 188 accommodates a cylindrical pin 192 attached to the seat frame 172. The pin 192 protrudes through the guide slot 188 and is operable to slide along the entire length of the slot 188 to facilitate folding of the walker 100, described in detail hereinafter.

Figure 4:
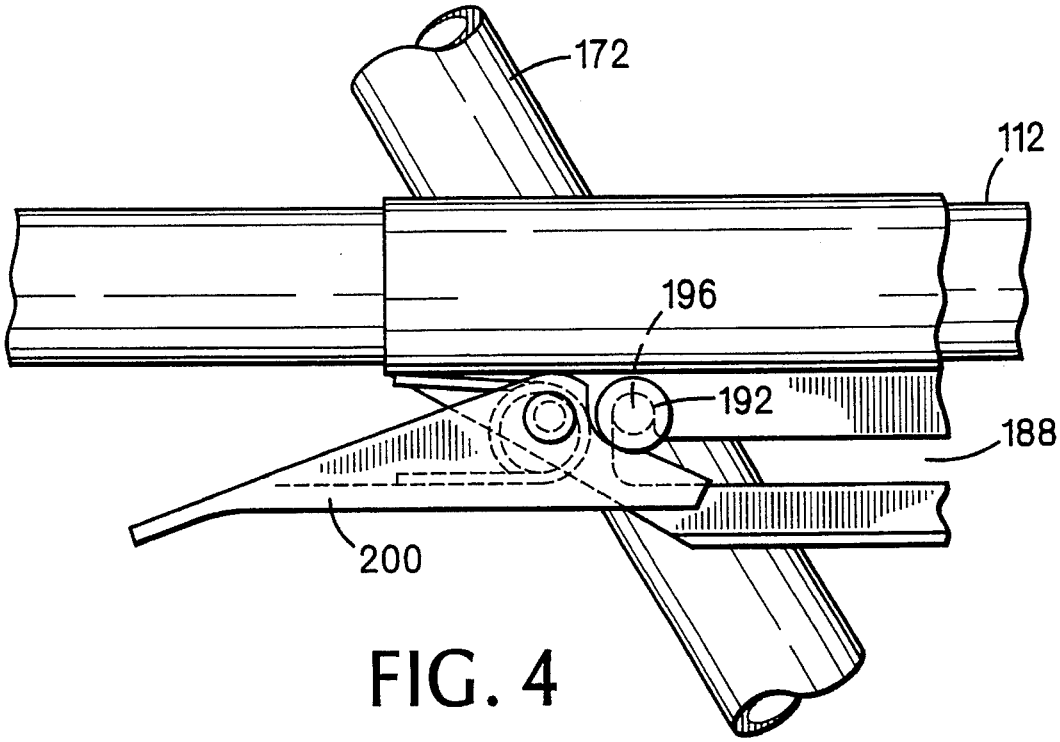
FIG. 4 is a detailed perspective view of one embodiment of a latching mechanism that forms a portion of the walker of FIG. 1.

Various methods of locking the arm pin 192 within the left-most end of the guide slot 188, as illustrated on FIG. 1, are contemplated by the present invention. FIG. 4 illustrates one embodiment in which the guide slot 188 is formed at its left-most end with a right-angled portion 196, or "L" slot. When the walker 100 is in its unfolded position, as illustrated in FIG. 1, a spring-loaded latch 200, illustrated in FIG. 4, holds the arm pin 192 within the "L" slot portion 196 of the guide slot 188. The "L" latch 200 keeps the walker 100 in the unfolded position for use. When the user desires to fold the walker 100 for e.g., storage or transportation, it is a simple matter for the user to lift up on the left-most end of the "L" latch 200 of FIG. 4, thereby releasing the pin 192 into the main portion of the guide slot 188. When in the unfolded position, the "L" latch 200 holds the pin 192 such that the pin 192 cannot be pulled out of the right-angled extension 196 of the slot 188 by lifting the arm 112. This type of "L" latch 200 does not carry any structural loading whereas the right-angled extension 196 of the guide slot 188 does. Further, only one "L" latch 200 for a seat frame pin 192 and guide slot 188 may be required.

Figure 5:
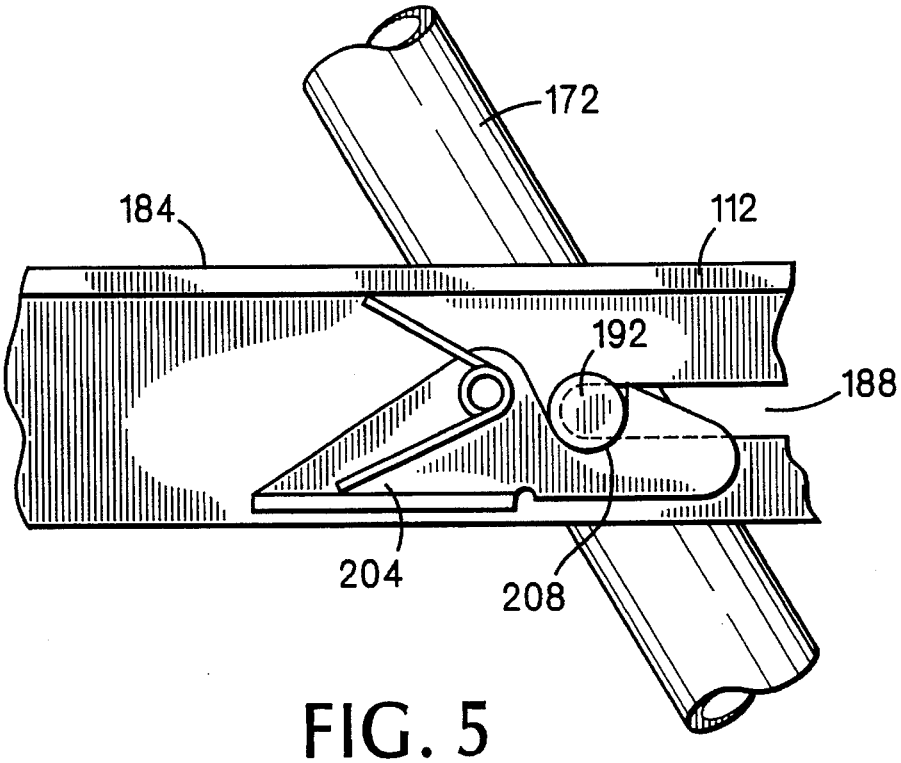
FIG. 5 is a detailed perspective view of a second embodiment of the latching mechanism that forms a portion of the walker of FIG. 1.

FIG. 5 illustrates an alternative embodiment of a latch and corresponding guide slot for use with the "slotted arm" concept of FIGS. 1–3. The "hook latch" 204 illustrated in FIG. 5 comprises a spring-loaded latch having a cylindrical-shaped recess 208 or hook latch portion formed therein. The recess 208 is operable to engage the arm pin 192 at the end of the guide slot 188 and hold it in place with the walker 100 in an unfolded position. In contrast to FIG. 4, no right angled extension 196 of the guide slot 188 is necessary with the hook latch 204 of FIG. 5. The hook latch 204 is operable to release the pin 192 for movement along the length of the slot 188 by pulling up on the left-most end of the latch 204 of FIG. 5. The hook latch 204 holds the pin 192 such that the pin 192 cannot be pulled out of the recess 208 in the hook latch 204 by either pulling or pushing on the arm 112 by the user. The hook latch 204 operates on a force-over-center principle. The hook latch 204 carries the structural loading between the arm 112 and the seat back 132. In the embodiment of FIG. 5, two hook latches 204 and pins 192 are normally required, one for each arm 112, to keep the wrap-around arm tube section 112 and seat back 132 rigidly connected.

Figure 6:
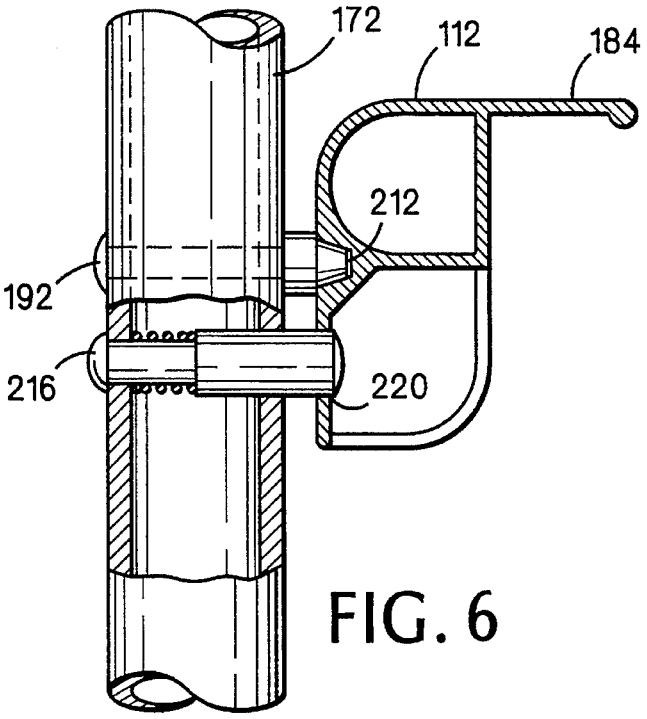
FIG. 6 is a detailed perspective view, in partial cross-section, illustrating a preferred embodiment of a pin and groove arrangement that forms a portion of the walker of FIG. 1.
Figure 7:
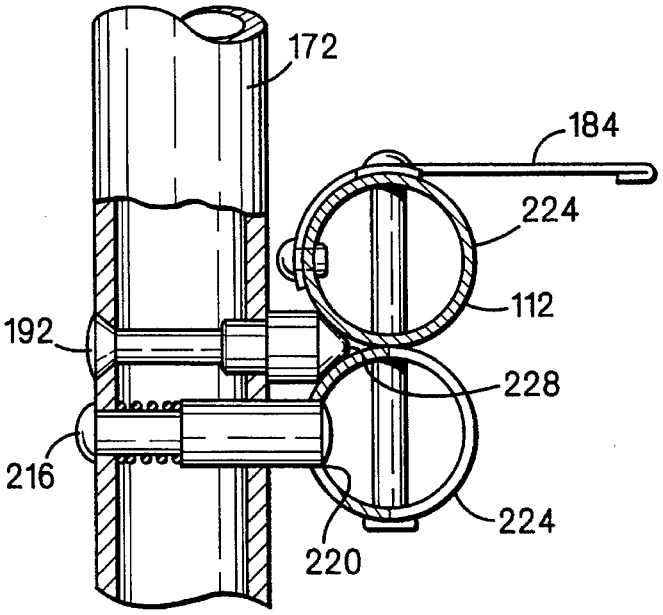
FIG. 7 is a detailed perspective view, in partial cross-section, illustrating an alternative embodiment of the preferred pin and groove arrangement of FIG. 6.

In contrast to the "slotted arm" concept of the extruded, right-angled arm 112 of FIGS. 1–5, the arm 112 may comprise, in a preferred embodiment, a "tubular-shaped" extrusion 112 having a groove 212 formed in the extrusion 112, as illustrated in FIG. 6. A first pin 192 is inserted through the seat frame tube 172 and the end of the pin 192 engages the groove 212 formed in the extrusion 112. A second, spring-loaded pin 216 fits in a hole 220 formed in the extrusion with the walker 100 in an unfolded position. The pin 216 is operated by disengaging it from the hole 220 when it is desired to enable the first pin 192 to slide along the length of the groove 212 to fold the walker 100. This spring-loaded pin 216 acts as a locking latch and functions much like the "L" latch 200 of FIG. 4 or the "hook" latch 204 of FIG. 5. FIG. 6 illustrates, in partial cross-section, this "extrusion groove" feature. FIG. 7 illustrates an alternative to the extrusion groove concept. The primary difference between FIG. 6 and 7 is that the arm 112 in FIG. 7 comprises a pair of cylindrical tubes 224 placed one on top of each other in a vertical orientation. The horizontal planar arm rest 184 is attached to the upper tube 224 by means of screws or rivets, whereas in FIG. 6, the horizontal planar arm rest 184 was formed as an integral portion of the extrusion arm 112. In FIG. 7, the pin 192 now rests in the "crevice" 228 formed in the vicinity of the junction of the two tubes 224. A spring-loaded pin 216 is also provided and operates in a similar manner to that disclosed in FIG. 6.

The walker 100 also includes a seat 108 that comprises a back portion 132 and a seat cushion 136. The seat back 132 comprises a curved piece of e.g., a metal, thermoformed plastic, or or other suitable rigid material that is attached to a cylindrical metal tube 172 that forms the seat frame 172. The tube 172 is bent in an inverted "U" configuration. The ends of the tube 172 connect to the corresponding T-shaped collars 168 by means of e.g., screws or pins. At the approximate midpoint of the sides of the tube 172 are disposed the arm pins 192 that engage the slots 188 of the arms 112, as described hereinbefore with respect to FIGS. 1–3. In the alternative, the tube 172 accommodates the rigid and spring-loaded pins 192, 216 of the preferred embodiment of FIGS. 6 and 7, described hereinbefore.

Also attached to the tube 172 are a pair of link members 232. The opposite end of each link member 232 attaches to a corresponding rear leg 124 of the walker 100. The rear legs 124 will be described in detail hereinafter.

Also pivotally attached to the seat tube 172 is a seat cushion 136. The seat cushion 136 may be comprised of a formed metal, thermoformed plastic, or other rigid material. On each side of the seat cushion 136 is provided a rigid brace 236 formed from a material such as a metal. These seat braces 236 pivotally attach to each rear leg 124 and the seat tube 172 by means of, e.g., screws or pins. Additional screws may be provided that attach the brace 236 directly to the cushion material. In a preferred embodiment of the present invention, when the walker 100 is in an unfolded, "in-use" position, such as that illustrated in FIG. 1, the relatively planar top of the seat cushion 136 is disposed at an angle of approximately 5 degrees of an up-incline with respect to the horizontal axis or floor.

As mentioned hereinbefore, the walker 100 also comprises a pair of identical rear legs 124. Similar to the front legs 120, the rear legs 124 comprise a lower outer tube 240 and an upper inner tube 244, wherein the upper tube 244 is smaller in diameter than the lower tube 240. This allows the upper tube 244 to fit within the lower tube 240 and be adjustable with respect thereto by means of a pin 248 that is selectively disposed in one of a plurality of holes (not shown) formed in the outer tube 244 and in a corresponding one of a plurality of holes (not shown) formed in the inner tube 240. Alternatively, a push button, spring-loaded latch 148 of FIG. 8 may be used as the height adjustment means on the rear legs 124. This provides for an overall height adjustment of the walker 100, in a similar manner to the front legs.

As mentioned hereinbefore, each rear leg 124 is pivotally attached to a corresponding seat brace 236 and also to a linking member 232. Also, the upper tubes 244 of each rear leg are rigidly connected together by a cross tube 252. However, in contrast to the front legs 120 and in accordance with a preferred embodiment of the present invention, the rear legs 124 may be provided with associated wheels 128 that facilitate movement of the walker 100 across a floor. The wheels 128 may comprise a rigid plastic or metal and polyurethane material. Each wheel 128 connects by a corresponding brace 256 that is attached to the bottom portion of the rear legs 124. Each rear leg 124 also includes a compression spring 260 disposed within the outer tube 240, as illustrated in FIG. 1. The spring 260 connects the upper portion of the wheel brace 256 to the outer tube 240.

When the walker 100 is used such that it is being advanced by a person who is not putting any weight on the seat 108, the bottom portion of each rear leg 124 is disposed off of the floor surface by a small amount. In this way, the user can easily advance the walker 100 forward. On the other hand, when the user begins to apply pressure to the seat 108, for example, in the context of a uncontrollable backwards fall, the force of the body striking the seat 108 overcomes the compression force of the spring 260 (approximately 15 lbs.) and moves the top of the wheel brace 256 with respect to the lower tube 240 such that the wheel 128 is effectively moved upward. This allows the bottom of each rear leg 124 to contact the floor surface and prevents any backward movement of the walker 100. In the alternative, the spring-loaded rear leg 124 may comprise that described and illustrated in U.S. Pat. No. 5,271,422, which is hereby incorporated by reference.

As mentioned hereinbefore, FIG. 1 illustrates the walker 100 of one embodiment of the present invention in an unfolded "in-use" position. On the other hand, FIG. 2 illustrates the walker 100 of FIG. 1 in a partially folded position. To facilitate the folding of the walker 100, the user depresses the push button, spring-loaded latches 180 on the canes 176, thereby releasing the canes 176 from the triangular-shaped collars 164. Further, the user also releases one or both (if provided) of the arm pins 192 from the corresponding latch (either the "L" latch 200 or the "hook" latch 204, of FIGS. 4 and 5, respectively, or the spring-loaded release pins 216 of FIGS. 6 and 7). The front legs 120, the lower tension members 116 and the arms 112 are then rotated upwards. This allows the pin 192 to slide within the slot 188 or groove 212 or crevice 228 (depending upon the embodiment). Then, the seat cushion 136 is lifted, which results in a completely folded walker 100 wherein the front and rear legs 120, 124, the lower tension members 116, the arms 112 and the seat back 132 and cushion 136 are arranged in a basic parallel configuration. The walker 100 folds compactly for ease in both storage and transportability.

Figure 9:
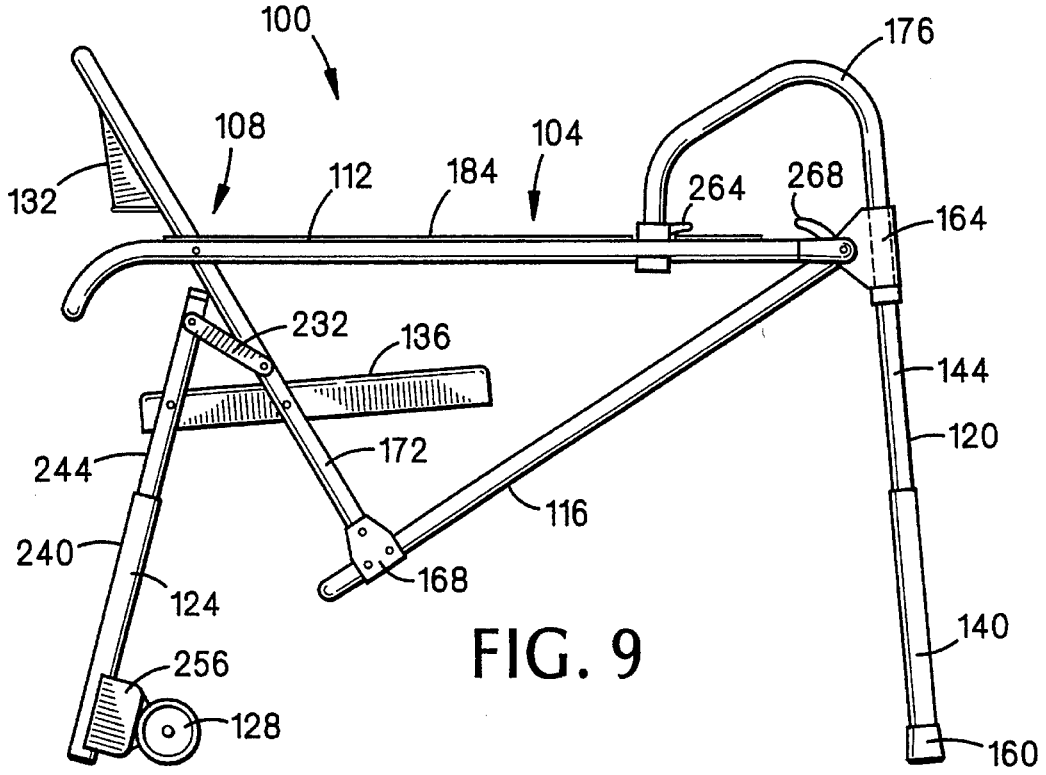
FIG. 9 is a side view of an alternative embodiment of a foldable safety walker illustrated in an unfolded position.
Figure 10:
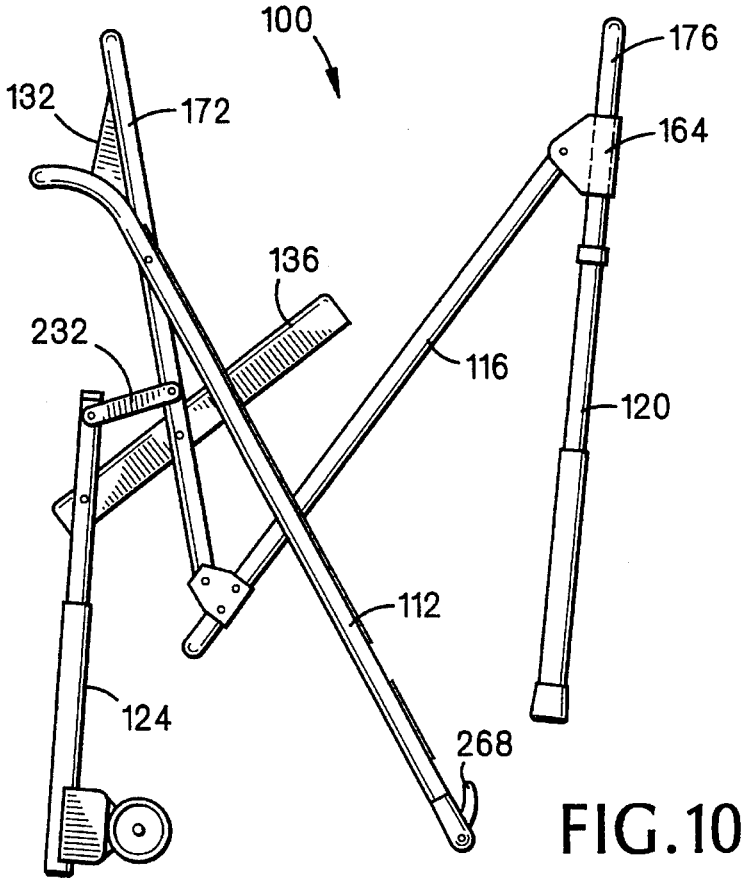
FIG. 10 is a side view of the walker of FIG. 9 illustrated is a partially folded position.

FIGS. 9 and 10 illustrate an alternative exemplary embodiment of the foldable safety walker 100 of the present invention. FIG. 9 illustrates a side view of the walker 100 in an unfolded position, while FIG. 10 illustrates the walker 100 in a partially folded configuration. The walker 100 of FIGS. 9 and 10 has several structural differences from the walker of FIGS. 1 and 2. Most notably, the walker 100 of FIGS. 9 and 10 has each lower tension member 116 terminated at the junction of the member 116 with the corresponding triangular-shaped collar 164. The canes 176 are thus formed as an integral extension of the upper tube 144 of each front leg 120. Each cane 176 extends to the rear and down to an interface of the cane 176 with a tubular arm member 112 at a corresponding latch 264. Each arm 112 now comprises a portion of a cylindrical tube that extends all the way to the triangular-shaped collar 164. The arm tube 112 pivotally attaches to separate locations on the seat tube 172. Each end of the arm tube 112 removably attaches to the triangular-shaped collar 164 by separate latch means 268. The arm tubes 112 are cross connected to the rear of the seat with an integral tube 112.

To fold the walker 100 of FIG. 9, the user initially unlatches each cane 176 from its attached position with the corresponding arm tube 112. The front legs 120 are then allowed to freely turn within the triangular-shaped collars 164. The legs may then be pushed downward within the collar to achieve their shortest overall length. Next, the user unlocks the end of each arm tube 112 from the triangular-shaped collar 164 by releasing the corresponding latch 268. The arms 112 are then allowed to pivot with respect to the seat tube 172 and are lowered toward the floor. The seat cushion 136 and lower tension braces 116 are then lifted upward and all members can be moved into a basically parallel configuration for easy storage and transportability.

The structural differences between the walker 100 of FIG. 9 and that of FIGS. 1–7 are such that the walker 100 of FIGS. 9 and 10 results in front leg joints that separate when folded. In contrast, the walker 100 of FIGS. 1–7 have front leg joints that do not separate when folded, which results in a design that requires fewer folding steps and has greater structural rigidity. Nevertheless, the walker 100 of FIGS. 9 and 10 illustrate several alternative embodiments of various features that are contemplated by the broadest scope of the present invention.

Figure 11:
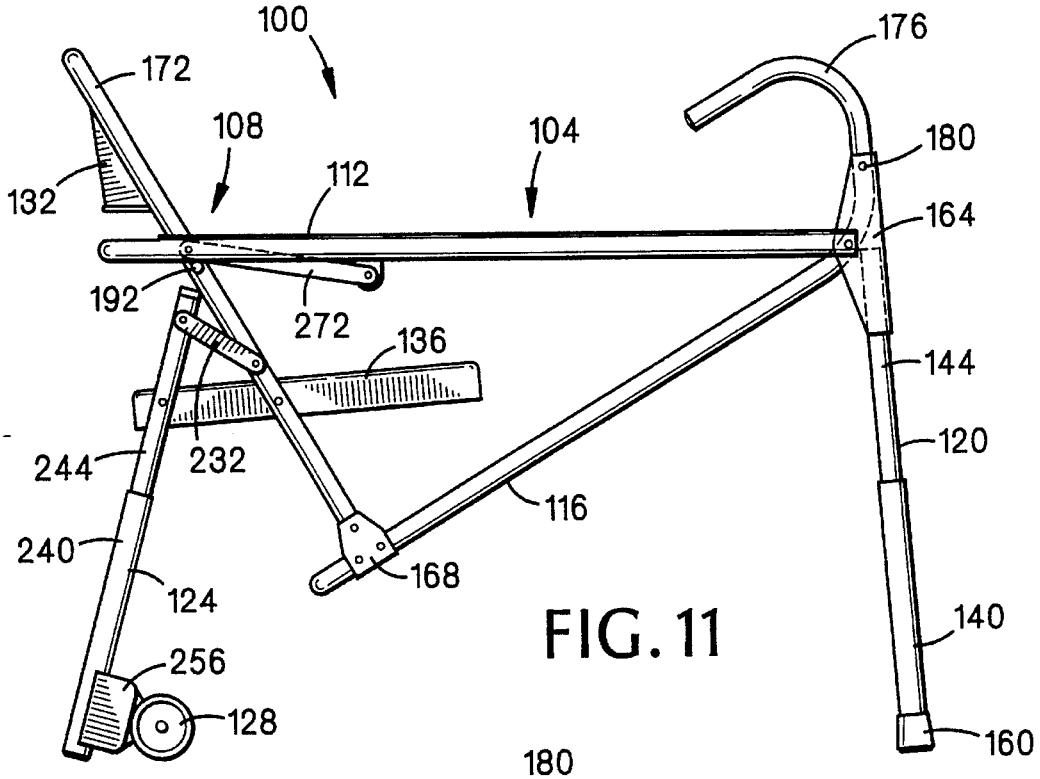
FIG. 11 is a side view of yet another alternative embodiment of a foldable safety walker illustrated in an unfolded position.
Figure 12:
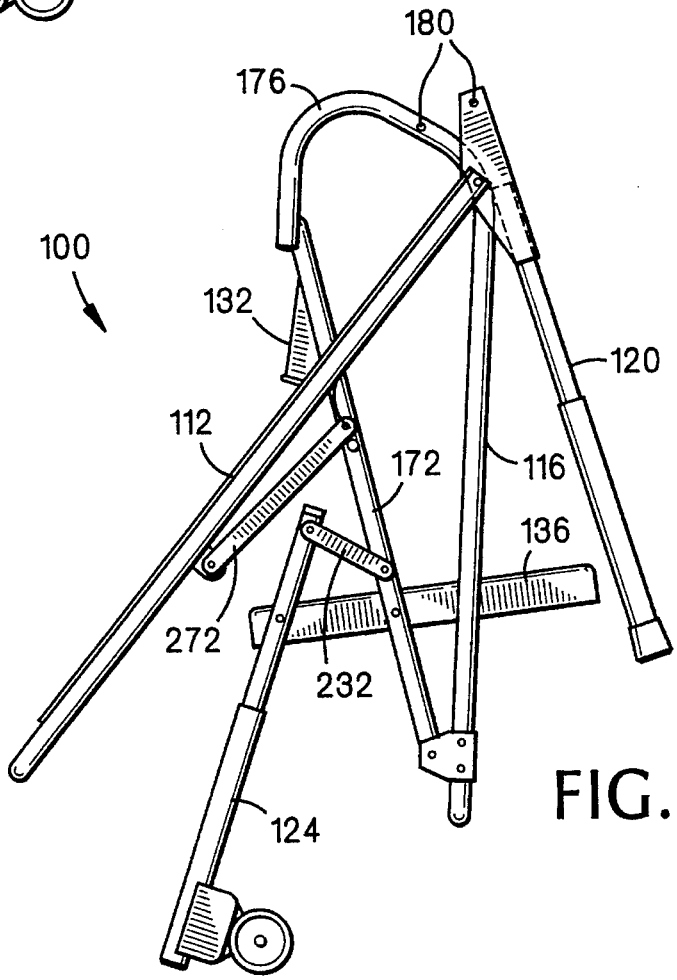
FIG. 12 is a side view of the walker of FIG. 11 illustrated in a partially folded condition.

FIGS. 11 and 12 illustrate still another embodiment of the foldable safety walker 100 of the present invention. The primary differences between the walker 100 of FIGS. 11 and 12 and that of FIGS. 1 and 2 are that the arm 112 now comprises a singular tube that extend the entire length to the triangular-shaped collars 164. Then, an over-center link 272 is added that comprises a link member 272 that is pivotally attached at one end to the seat tube 172 and at the other end to a point on the underside of the arm tube 112. This over-center "swing" link 272 creates a four bar linkage comprising the seat back 132, lower tension member 116, arm tube 112, and the over-center link 272. In FIG. 11, the arm 112 rests on the arm pin 192 protruding from the seat tube 172. The compression force generated by the seated user keeps the arm locked down by the over-center link 272. This results in a toggling-type action and is enhanced by friction in the pinned joints to eliminate looseness.

In FIG. 12, the walker 100 of FIG. 11 is illustrated in a partially folded position. The user initially depresses the push button spring-loaded latches 180 to release the cane extensions 176 of the lower tension members 116 from their corresponding triangular-shaped collars 164. Then, the user rotates the arms 112 and lower tension members 116 up, thereby allowing the over-center link 272 to swing approximately 240 degrees until the arm 112 and rear legs 124 are approximately parallel as illustrated in FIG. 12. Then, the user lifts up the front of the seat cushion 136, thereby folding the walker 100 into a series of parallel members. If desired the initial step described above of depressing the latch 180 to release the cane extensions 176 may be performed at any time in the above sequence of steps.

The foldable walker 100 of the present invention in its broadest scope provides for several distinct functions. When assembled in an unfolded or "in-use" position, the walker 100 provides a space and support for a person walking forward of the seat 108. A person with limited walking ability for whatever reason is able to stand erect and walk forward by stepping or shuffling his/her feet. The relatively light-weight (approximately 12 lbs. or less), walker 100 of the present invention is easily advanced forward by the user by means of a light pulling force applied to the canes 176. The walking cane-like front legs 120 are structurally tied together by way of the arms 112 and the lower tension members 116. In the broadest scope, the arm 112 and lower tension member 116 each comprises a structural member, for example, tubing, that flanks both sides of the user when within the walking space, and also "wraps around" behind the seat 108. This continuous or uniform configuration for both the arm 112 and lower tension member 116, as seen best in FIG. 3, assures that the arm 112 and lower tension member 116 on one side of the frame 104 are rigidly tied to the corresponding arm 112 and lower tension member 116 on the other side of the frame 104. Thus, torsional loading can be transferred from one side of the frame 104 to the other.

If desired, the canes 176 on the front legs 120 may be fitted with comfortable, foam-padded grips (not shown), and the canes 176 may be turned outward for a more comfortable wrist attitude for the user while carrying the user's weight as he/she moves forward. Further, although not shown, an optional front brace may be added between the front legs to provide additional support for the user. Yet, with a shaped structure of interconnected tubular members as described herein, no such front brace is necessary. The front brace may swing to one side to permit the user to enter and exit the walker 100 easily. However, such front brace may cause the user to feel a sense of undue restraint. It is important in a walker design that the walker 100 promote independence and freedom of movement for the user.

Another function of the foldable safety walker 100 of the present invention is that it provides a seat 108 immediately behind the walking space. This allows the user to easily transfer from an erect walking position to a seated, at-rest position or vice versa. Perhaps, the primary function of the foldable safety walker 100 of the present invention is that it provides a means of arresting the backward fall of a user. The seat back 132 and seat cushion 136, together with the supporting legs 120, 124 and self-breaking rear wheels 128 and leg tips 276 on the rear legs absorb the impact loading of the falling user. The high floor contact friction coefficient prevents the user and walker from sliding backwards. Thus, the user is prevented from falling off the seat and falling directly all the way to the floor.

The rigid seat assembly provides two contact edges to arrest the falling user: the front edge of the seat cushion 136 and the top of the seat back 132. If the falling user first contacts the front edge of the seat cushion 136, the user will begin to apply a downward and backward force on this edge. The downward component of the force activates the rear wheel/brake mechanism. Typically, the compression spring 260 in each rear leg 124 will be overcome with a compressive force applied thereto of approximately 15 lbs. The downward component of this force overcomes this spring force, which allows the lower portion of each outer tube 240 of each rear leg 124 to contact the floor, thereby preventing the wheels 128 from rolling. Only a sliding motion between the wheel-leg assembly and the floor is permitted. The lower end of each outer tube of each leg can be equipped with a high friction rubber tip 276 to further decrease the sliding ability of these legs. If the user's force application angle with respect to the horizontal is such that its tangent has a higher value than the friction coefficient between the floor and the lower tips 276 of each rear leg 124, then the walker 100 will not move backwards.

At sometime during the descent of the user, depending upon the distance between the user's legs at the start of the descent, a rigid person may contact the edge of the seat cushion 136 at an angle less than that desired. The walker 100 will then slide somewhat until the force angle tangent is greater than the floor friction coefficient. With proper proportions of the seat back height to the height of the front of the seat cushion 136 above the floor, the sliding will cease before the rigid user touches both the front of the seat cushion 136 and then the seat back 132. This permits the patient to fall into a seated position. In an exemplary embodiment of the present invention, the top of the seat back 132 is approximately 30 inches above the floor, the front edge of the seat cushion 136 is approximately 16 inches above the floor, and the top of the arm 112 is approximately 6 inches above the top of the front edge of the seat cushion 136. The seat back 132 is at an approximate angle of 58 degrees with respect to the horizontal, or the floor. Further, the rear legs 124 are at an angle of approximately 75 degrees with respect to the horizontal or the floor.

These dimensions, while purely exemplary, are key to a proper design of the walker 100 of the present invention in arresting the backward fall of a user. If the user is so far forward at the time of a rigid backward fall that he/she may contact the seat back 132 initially, then no sliding action will result. The walker 100 may rotate upwards somewhat until the front of the seat cushion 136 engages the user's legs or backside, thereby arresting the fall of the user. The user would then fall into a seated position. The rigidity of the walker 100 of the present invention is that quality of the walker 100 that is its resistance to flexure. Since all materials are elastic to one degree, the walker 100 has its maximum flexures or deflections undetectable in order to give the user a measure of confidence in the walker's structure. Lateral loadings to structural members create the greatest overall contributions to total deflection. By shortening the distance between the load application point, usually a joint, and the nearest joint, the reductions in rigidity have been minimized. In all of the functional operational modes of the walker 100, the number of members that carry the major portions of the working load in an axial direction have been maximized by the truss-like nature of the frame 104 of the walker 100. Axial loads in members do not result in perceptible deflections and therefore triangular orientations of the members one to another result in a rigid structure.

There exist three loading conditions that create maximum stress conditions in any structural member of the walker 100. These conditions are walking, seating, and falling. In a walking condition, the user's stabilizing pressure on the canes 176 result in a major portion of those forces (approximately 75–100%) being transferred directly down each leg 120, 124 to the floor. The remainder is applied laterally to the arm 112, thereby creating a bending, loading and transferring through the arm 112 the remainder of the downward loading through to the rear wheels 128. A small tension force in the lower tension members 116 and complimentary compression forces in the arms 112 stabilize the entire front end of the structure. The remainder of the force is distributed through the rear seat assembly 108 at a fraction of the values experienced in the seated mode of operation. The force applied outwardly to each leg handle or cane 176 is resisted torsionally by the tension brace 116 and arm 112 through the cross members to the member of the opposite side and then the cane 176 of the opposite leg 120.

In the seated position, the user applies his/her weight more evenly to each of the four legs. This results in the highest stresses that can occur in the lower tension members 116, in the arms 112 and in the seat tube 172. The maximum load in this sitting situation occurs when the user is seated on the front edge of the seat cushion 136.

When the user is falling backwards, the fall is arrested by the seat 108 and the major portion of the impact force is directed toward the rear legs 124. The downward component of the impact force is distributed to the four legs 120, 124 and activates the wheel brakes. No sliding occurs if the resisting force, i.e., the sum of the leg forces times the friction coefficient, is greater than the horizontal component of the impact force. The maximum impact force will reach a value of at least twice the value of the maximum comparable seated value if the walker 100 elastically deflects to absorb the impact energy. These impact stresses are the maximum stress levels that dictate the materials used in the construction of the walker 100. In the preferred embodiment of the present invention, the energy absorbing members, i.e., the legs, the lower tension braces 116 and the arms 112 preferably comprise either aluminum or steel, both of which are linearly elastic within their safe stress ranges.

The foldable safety walker 100 of the present invention has been described as having front legs 120 with lower rubber tips contacting the ground, and a pair of rear legs 124 that have rear wheel-brake arrangements. It is to be understood that this is purely exemplary. The broadest scope of the present invention contemplates a walker 100 having all four legs 120, 124 with wheels or all four legs without wheels. However, as described herein with respect to the exemplary embodiments, the two rear legs 124 have spring-loaded brake assemblies. In normal operation, the lower portion of the outer tube 240 of each rear leg 124 is off the ground until a sufficient force is applied to the seat 108 to overcome the spring force of the wheel-brake assembly. Also, during this normal operation, the front legs 120 of the walker 100 are raised off the ground slightly, to facilitate movement of the walker 100 by a user.

Further, one embodiment of the invention has illustrated the canes 176 as being integrally attached or formed with the lower tension members 116. A second embodiment of the invention has illustrated the canes 176 as being integrally attached as extensions of the legs 116. Either type of cane 176 is contemplated by the present invention.

It should be understood by those skilled in the art that obvious structural modifications can be made without departing from the spirit of the invention. Accordingly, reference should be made primarily to the accompanying Claims, rather than the foregoing Specification, to determine the scope of the invention.

Having thus described the invention, what is claimed is:

1. A foldable safety walker, comprising:

a. a pair of upstanding height-adjustable front legs spaced apart and separate from each other;

b. a pair of hand-gripable handles, each handle being connectable with a corresponding one of the pair of front legs;

c. a pair of lower tension members, each lower tension member being connectable with a corresponding one of the pair of front legs, both lower tension members being connected to each other at a rear portion by a lower tension member wrap around extension;

d. a pair of arm members, each arm member being connectable with a corresponding one of the pair of front legs;

e. a seat frame connectable to each lower tension member and to each arm member;

f. a seat back formed within the seat frame;

g. a seat cushion connectable with the seat frame; and h. a pair of height-adjustable rear legs spaced apart and separate from each other, each rear leg being connectable to the seat cushion and to the seat frame, wherein the front legs, arm members, lower tension members, handles and seat cushion define a walking space for an upright user of the walker, and wherein each rear leg is pivotally connectable to the seat frame by a corresponding link member.

2. The walker of claim 1, further comprising means for connecting each one of the handles, each one of the lower tension members, and each one of the arm members to a corresponding one of the pair of front legs.

3. The walker of claim 2, wherein each handle is formed as an integral extension portion of each corresponding lower tension member, and wherein the means for connecting comprises means for releasably connecting each handle with the corresponding one of the front legs.

4. The walker of claim 3, wherein the means for releasably connecting comprises a push button, spring-loaded latch.

5. The walker of claim 1, wherein both arm members are connected to each other at a rear portion by an arm member wrap around extension.

6. The walker of claim 1, wherein each handle is releasably connected to a corresponding one of the arm members.

7. The walker of claim 6, further comprising latch means for releasably connecting each handle to a corresponding one of the arm members.

8. The walker of claim 1, further comprising latch means for releasably connecting each arm member to a corresponding one of the front legs.

9. The walker of claim 1, wherein each rear leg includes a wheel and means for selectively preventing rolling motion of the wheel.

10. The walker of claim 1, wherein at least one arm member includes a guide slot formed along a predetermined length thereof, and wherein the seat frame includes at least one pin operable to be constrained to travel within the guide slot.

11. The walker of claim 10, further comprising latch means for releasably holding the pin at one predetermined location within the guide slot, the walker being in an unfolded position when the pin is held within the guide slot at the predetermined location by the latch means. When the pin is released by the latch means, the pin may travel along the length of the guide slot to facilitate the folding of the walker.

12. The walker of claim 11, wherein the latch means comprises spring-loaded latch means for releasably holding the pin in a hook-latch portion of the spring-loaded latch means by way of the force exerted by a spring.

13. The walker of claim 12, wherein the guide slot has an extension portion that is formed at an angle with respect to the remainder of the direction of the guide slot, the latch means comprising means for holding the pin in the guide slot extension portion.

14. The walker of claim 1, further comprising at least one link member pivotally connected at one end to the seat frame and at a second end to one of the arm members, the link member being pivotally rotatable with respect to both the arm member and the seat frame to facilitate folding of the walker.

15. The walker of claim 1, wherein each arm member has an arm rest portion that is generally planar in a plane parallel to a floor upon which the walker is in use when the walker is in an unfolded position.

16. The walker of claim 1, wherein at least one arm member includes a guide slot formed as a depression in a portion of a material comprising the arm member, and wherein the seat frame includes at least one pin operable to be constrained to travel within the guide slot.

17. The walker of claim 16, further comprising latch means for releasably holding the pin at one predetermined location within the guide slot, the walker being in an unfolded position when the pin is held within the guide slot at the predetermined location by the latch means, when the pin is released by the latch means, the pin may travel along the length of the guide slot to facilitate the folding of the walker.

18. The walker of claim 1, wherein at least one arm member comprises at least two cylindrical tubes stacked vertically on top of each other such that a crevice is formed bounded by the two tubes in the approximate vicinity of the interface point of the two tubes, and wherein the seat frame includes at least one pin operable to be constrained to travel within the crevice, and further comprising latch means for releasably holding the pin at one predetermined location within the crevice, the walker being in an unfolded position when the pin is held within the crevice at the predetermined location by the latch means, when the pin is released by the latch means, the pin may travel along the length of the crevice to facilitate the folding of the walker.

19. The walker of claim 1, wherein said rear leg is connected to each other by a transverse cross member.

* * * * *